US011904254B2

(12) United States Patent
Hart

(10) Patent No.: US 11,904,254 B2
(45) Date of Patent: Feb. 20, 2024

(54) SYSTEM AND METHOD FOR A MAGNETIC BLOCK ASSEMBLY

(71) Applicant: Aaron August Hart, Greenville, TX (US)

(72) Inventor: Aaron August Hart, Greenville, TX (US)

( * ) Notice: Subject to any disclaimer, the term of this patent is extended or adjusted under 35 U.S.C. 154(b) by 0 days.

(21) Appl. No.: 17/899,165

(22) Filed: Aug. 30, 2022

(65) Prior Publication Data

US 2023/0061357 A1 Mar. 2, 2023

Related U.S. Application Data

(60) Provisional application No. 63/239,400, filed on Aug. 31, 2021.

(51) Int. Cl.
*A63H 33/10* (2006.01)
*A63H 33/04* (2006.01)

(52) U.S. Cl.
CPC ..... *A63H 33/046* (2013.01)

(58) Field of Classification Search
CPC ..... A63H 33/046
See application file for complete search history.

(56) References Cited

U.S. PATENT DOCUMENTS 3,254,440 A * 6/1966 Duggar ..... A63H 33/046 446/92
3,601,921 A * 8/1971 Strohmaier ..... A63H 33/046 446/92
5,520,396 A * 5/1996 Therrien ..... A63F 9/34 273/156
6,241,249 B1 * 6/2001 Wang ..... A63F 9/1204 273/156
8,850,683 B2 10/2014 Haughey et al.
9,751,025 B2 * 9/2017 Kiribuchi ..... A63H 33/046
9,873,061 B2 1/2018 Cheung
(Continued)

FOREIGN PATENT DOCUMENTS

CN 108371823 A 8/2018
CN 108635885 A 10/2018
CN 107441733 B 6/2019
CN 110180194 A 8/2019
DE 202019001510 U1 6/2019
(Continued)

OTHER PUBLICATIONS

Jieshang, Machine Translation of CN108371823A, uploaded Aug. 15, 2023, Espacenet, 4 pages.*
(Continued)

*Primary Examiner* — Eugene L Kim
*Assistant Examiner* — Matthew B Stanczak
(74) *Attorney, Agent, or Firm* — Bold IP, PLLC; Christopher Mayle

(57) ABSTRACT

A system and method for magnetic building block toys that provide free rotation in any direction creating a higher freedom of movement and design whereby when assembled, the building blocks create effects only typically seen in digital environments such as computer aided designs or video game, whereby due to utilizing magnets for these connections, the base play area is no longer restricted to a flat horizontal playing area such as the table or the ground and instead a piece of ferromagnetic material including an iron plate may be utilized as a design area allowing for greater flexibility for creativity.

10 Claims, 6 Drawing Sheets

(56) References Cited

U.S. PATENT DOCUMENTS

| | | | | |
|---|---|---|---|---|
| 9,873,062 | B2 | 1/2018 | Purns | |
| 11,406,909 | B2 * | 8/2022 | Zhang | A63H 33/26 |
| 2010/0242250 | A1 * | 9/2010 | Haughey | A63H 33/046 29/428 |
| 2015/0000102 | A1 * | 1/2015 | Haughey | A63H 33/046 29/428 |
| 2015/0004870 | A1 * | 1/2015 | Haughey | A63H 33/046 446/92 |
| 2015/0262744 | A1 | 9/2015 | Wei | |
| 2015/0283475 | A1 | 10/2015 | Hiller | |
| 2016/0288008 | A1 | 10/2016 | Wong | |
| 2017/0239586 | A1 | 8/2017 | Marcil | |
| 2017/0340980 | A1 | 11/2017 | Marcil | |
| 2018/0056204 | A1 * | 3/2018 | Knudsen | A63H 33/046 |
| 2019/0201804 | A1 * | 7/2019 | Khalus | A63H 33/046 |
| 2020/0398175 | A1 | 12/2020 | Rosen et al. | |
| 2020/0406156 | A1 * | 12/2020 | Rosen | A63H 33/042 |
| 2023/0061357 | A1 * | 3/2023 | Hart | A63H 33/046 |

FOREIGN PATENT DOCUMENTS

| | | | | |
|---|---|---|---|---|
| EP | 3549649 | A1 | 9/2019 | |
| JP | H08257252 | A * | 10/1996 | A63H 33/10 |
| KR | 200377822 | Y1 | 2/2005 | |
| KR | 1020070067979 | A | 6/2007 | |
| KR | 101036721 | B1 | 5/2011 | |
| KR | 1020110100706 | A | 9/2011 | |
| KR | 1020120049991 | A | 5/2012 | |
| KR | 1020140067453 | A | 6/2014 | |
| KR | 101994409 | B1 | 7/2019 | |
| KR | 102018601 | B9 | 11/2019 | |
| KR | 1020200137564 | A | 12/2020 | |
| WO | 2018157223 | A1 | 9/2018 | |
| WO | WO-2018157223 | A1 * | 9/2018 | A63H 33/06 |

OTHER PUBLICATIONS

Masami, Machine Translation of H08257252A, uploaded Aug. 15, 2023, Espacenet, 4 pages.*

* cited by examiner

SYSTEM AND METHOD FOR A MAGNETIC BLOCK ASSEMBLY

CROSS REFERENCE TO RELATED APPLICATIONS

This application claims priority to U.S. Provisional Patent Appl. Ser. No. 63/239,400 filed on Aug. 31, 2021

FIELD OF DISCLOSURE

The overall invention relates to toys and, more particularly to, toy building blocks having magnetic interaction to hold the building blocks together to create various objects.

BACKGROUND

Different types and designs of magnetic blocks (as items of toy construction kits) have been widely known over the years. Most toy blocks currently do not use friction fitting to align or connect pieces, which causes the toy blocks to not operate in a cohesive and unchanging form. The current toy blocks also have not succeeded on the market because they are not made of extrudable materials such as wood or fabric, leading to color imitations and creating a lack of variety and attraction in a younger audience. Other products currently do not use an injection molding process to produce a sustainable output for manufacture and sale. These toy blocks are more complex to build, thus leading to frustration in those of a lower skill level. The price of these toy blocks are also much higher because the magnets in general are above a certain size, causing the materials to become more expensive. Thus exists a need for a cost effective size and construction for toy blocks that uses magnetic attraction with a fewer amount of pieces.

SUMMARY

The present disclosure recognizes the unsolved need for mechanical connections in building block toys that provide free rotation in any direction creating a higher freedom of movement and design. When assembled, the building blocks create effects only typically seen in digital environments such as computer aided designs or video game. Due to utilizing magnets for these connections, the base play area is no longer restricted to a flat horizontal playing area such as the table or the ground and instead a piece of ferromagnetic material including an iron plate may be utilized as a design area allowing for greater flexibility for creativity.

The design of the building blocks is compatible in larger or smaller variations because of the magnetic connections not requiring any physical hole or connective pieces to work together. The six sided cuboid shape of the present invention allows connections to occur with a copy on all sides, given they face the same direction. This differs from a typical cube magnet in that the design can be rotated to change direction while still allowing a minimum of three sides to connect to another copy. The created effect makes it appear like all sides connect even when not facing the same direction, thus reducing the frustrating repelling behavior of the magnets and increasing interoperability.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1A:
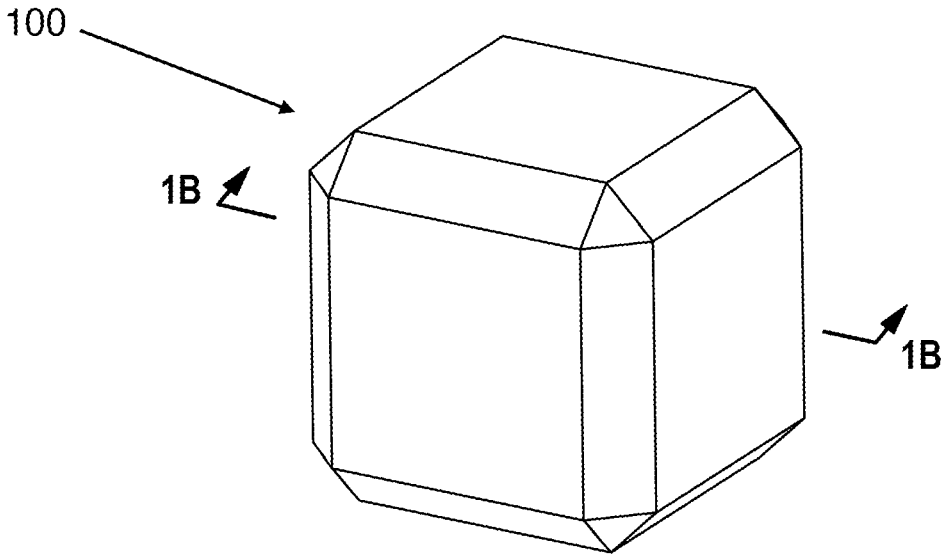
FIG. 1A is an illustration of a magnetic building block in accordance with the present invention.

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

"Exemplary" is used herein to mean "serving as an example, instance, or illustration." Any aspect described in this document as "exemplary" is not necessarily to be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any items, so a "set of items" may indicate the presence of only one item or may indicate more items. Thus, the term "set" may be equivalent to "one or more" as used herein.

Figure 1B:
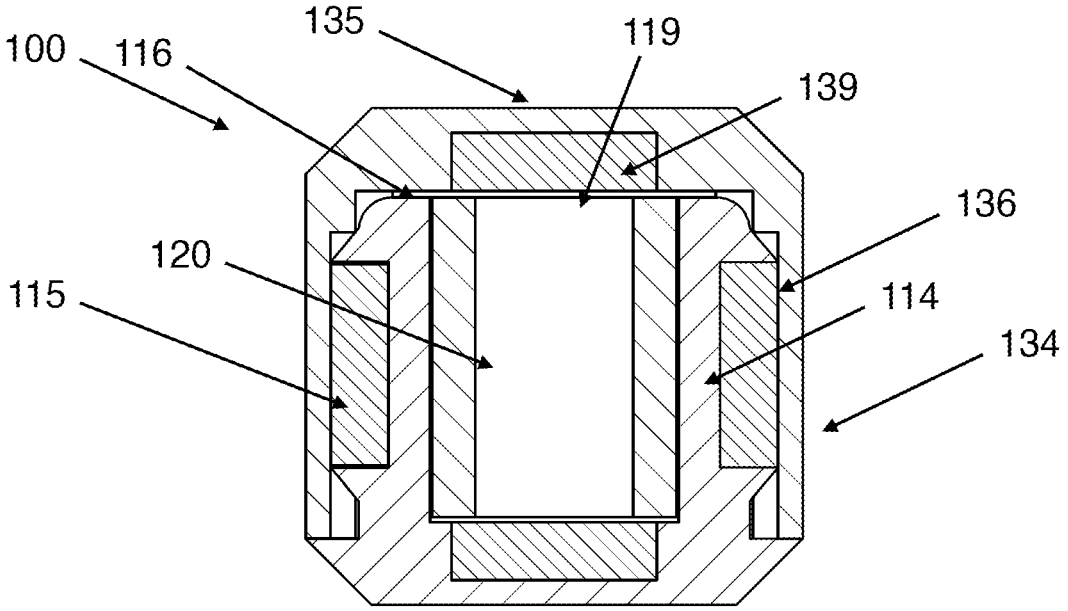
FIG. 1B is a breakaway view of FIG. 1A.
Figure 1C:
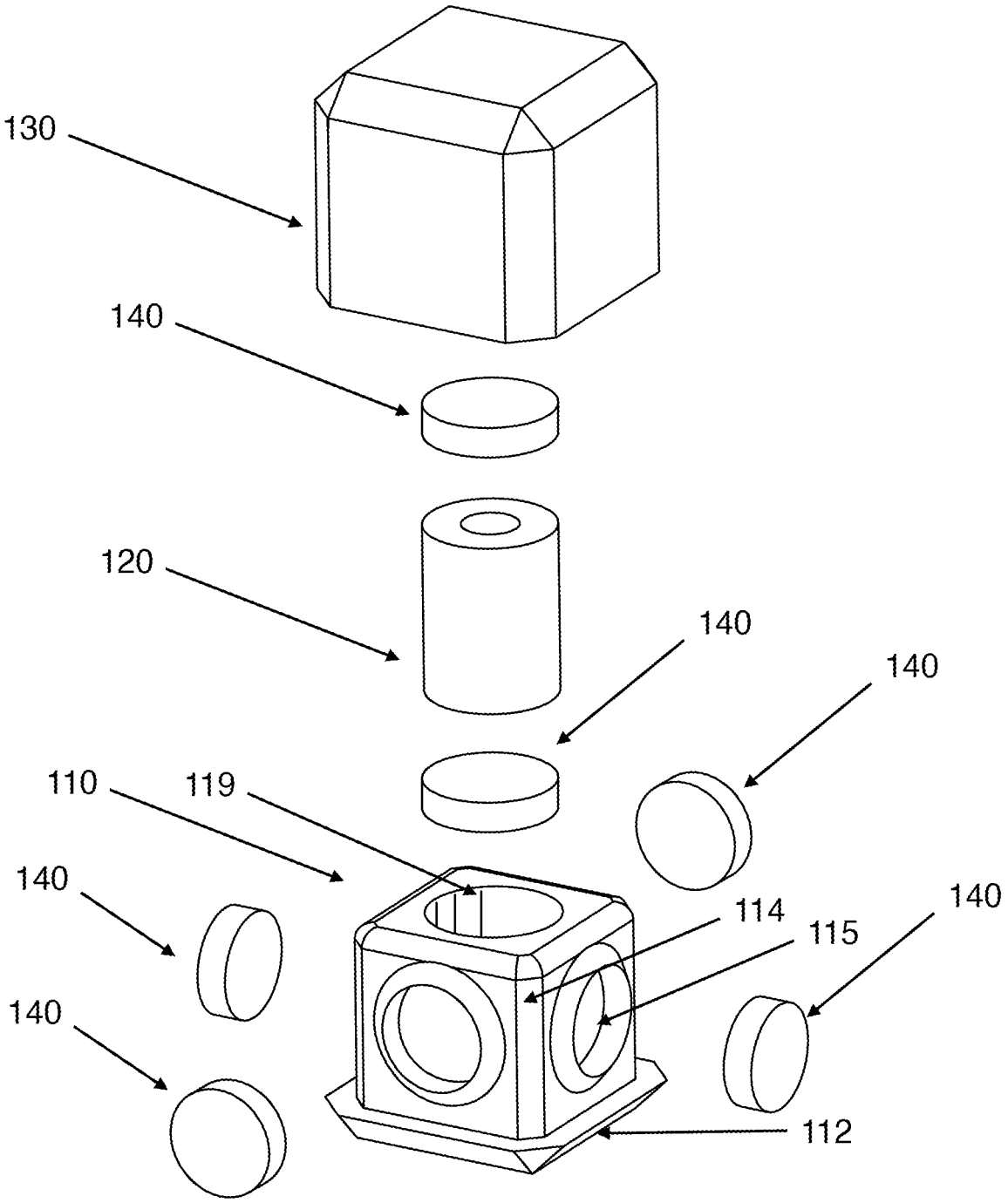
FIG. 1C is an exploded view of FIG. 1A
Figure 2:
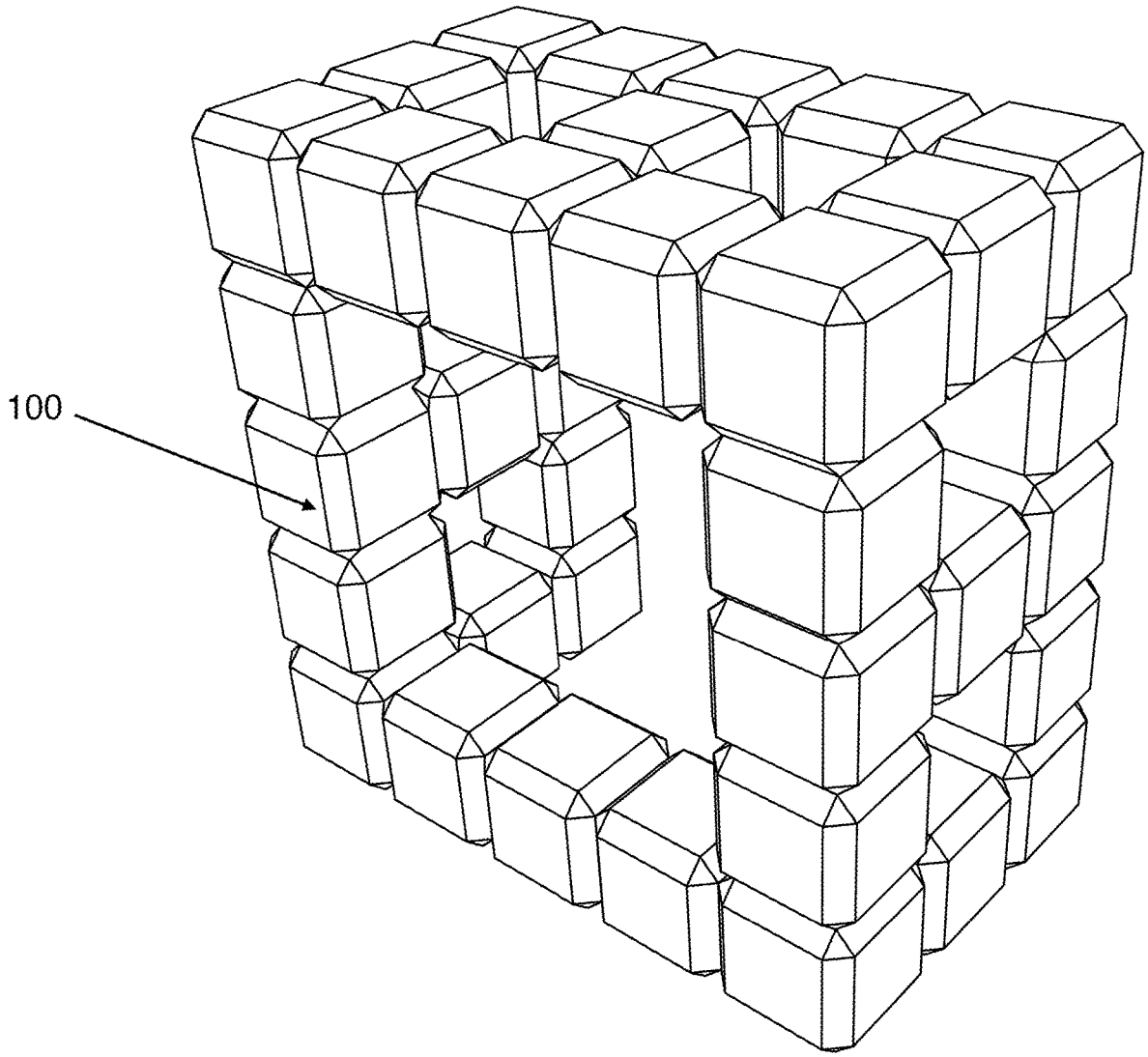
FIG. 2 is an blown out view of the magnetic building block.

FIG. 1A-1C illustrate a view of building block 100 in accordance with the embodiments of the present invention. Building block 100 has three main parts, a base component 110, a middle pin 120, and a top component 130, whereby magnets 140, as illustrated in FIG. 2 are installed in base component 110 and top component 130 in a specific orientation. Each side or face opposite of another of the assembled building block 100 may have a magnet 140 in the same orientation when assembled. Each building block 100 is intended to work with another building block 100 because it should have the same mapping as the others.

Base component 110 is hollow with an interior cavity, as illustrated in FIG. 2 Base component 110 has square base surface 112 and a series of square sidewalls 114 that extend upward from an inner portion of base surface 112 whereby base surface 112 is of a greater perimeter and area than the perimeter and area formed by sidewalls 114. Sidewalls 114 extend upward into a top surface 116. Top surface 116 is square in shape and has a cylindrical aperture 119 at a center of top surface 116 that extends downward into the interior cavity. Base component 110 has four friction fit holes 115 on each of the surfaces of sidewalls 114 to hold magnets 140. Friction fit holes 115 have surrounding ridges that extend perpendicularly outward from sidewalls 114. The ridges act as a natural guide for top component 130 as well as decrease the distance that the magnetic field of magnets 140 has to travel through to interact with another building block 100, thereby increasing architectural attractive strength. The interior cavity is sized to accommodate the fifth magnet 140 as well as middle pin 120.

Base component 110 has natural walls formed from flattening the outer edges which prevents top component 130 from going past a certain length while also creating the illusion that the construction of building block 100 is seamless when put together. Base component 110 has smooth edges such that an even entry is possible when base component 110 and top component 130 are connected together.

Middle pin 120 is a hollow cylindrical tube and designed to prevent the fifth magnet 140 in base component 110 and sixth magnet 140 in top component 130 from attracting one another and coming together. In other non-limiting embodiments, middle pin 120 may be replaced by glue or another form of filler to fill the void between fifth magnet 140 and sixth magnet 140.

Top component 130 is a hollow cube with an open bottom, as illustrated in FIG. 1. Top component 130 has a series of sidewalls 134 extending upward into a top surface 135. Top surface 135 has a recessed cavity 139 to house the sixth magnet 140. One or more slits or indented archways 136 are formed on an interior of each of sidewalls 134 to allow magnets 140 located on sidewalls 114 of base component 110 to slide together smoothly and to simplify manufacturing as well as decrease the distance between magnets 140 in two separate building blocks 100. The corners next to two of archways 136 are flattened allowing a friction fit while acting as a guide for base component 110 and top component 130 to slide together. The area of base surface 112 is slightly smaller than the area of the inner surface of top component 130 allowing top component 130 to fit over and secure base component 110.

Figure 3:
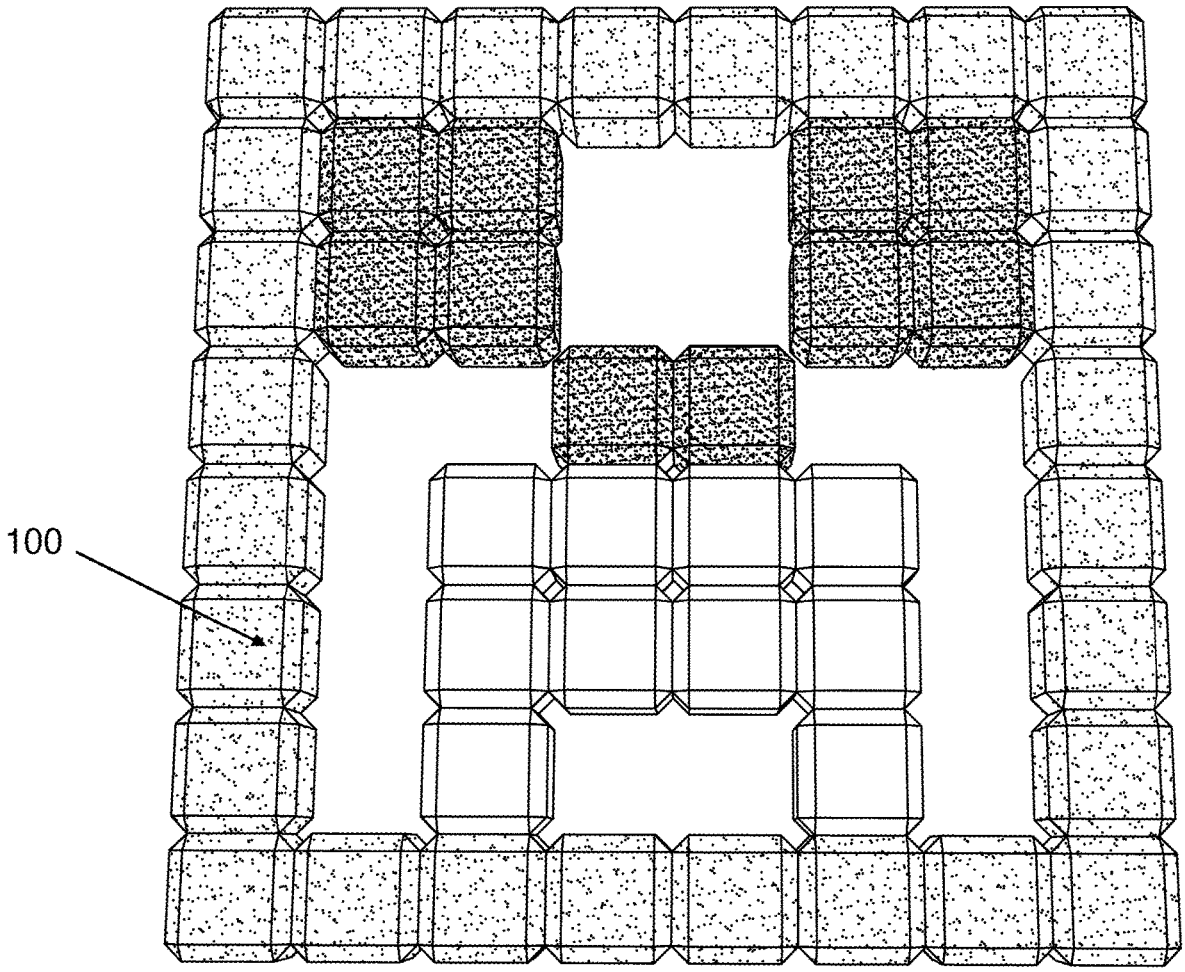
FIG. 3 is another picture of the building blocks when assembled.
Figure 4:
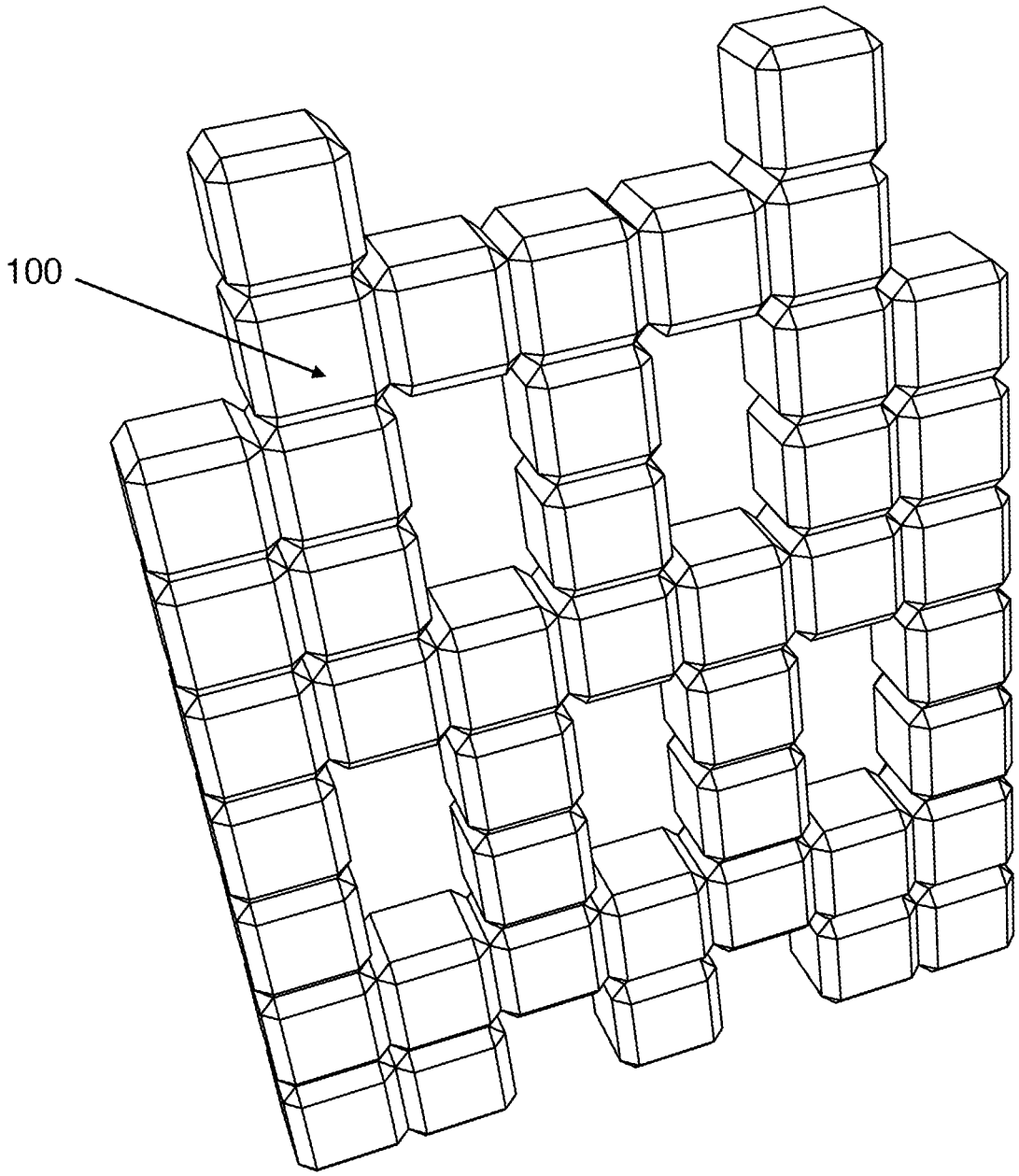
FIG. 4 is another picture of the building blocks when assembled.
Figure 5:
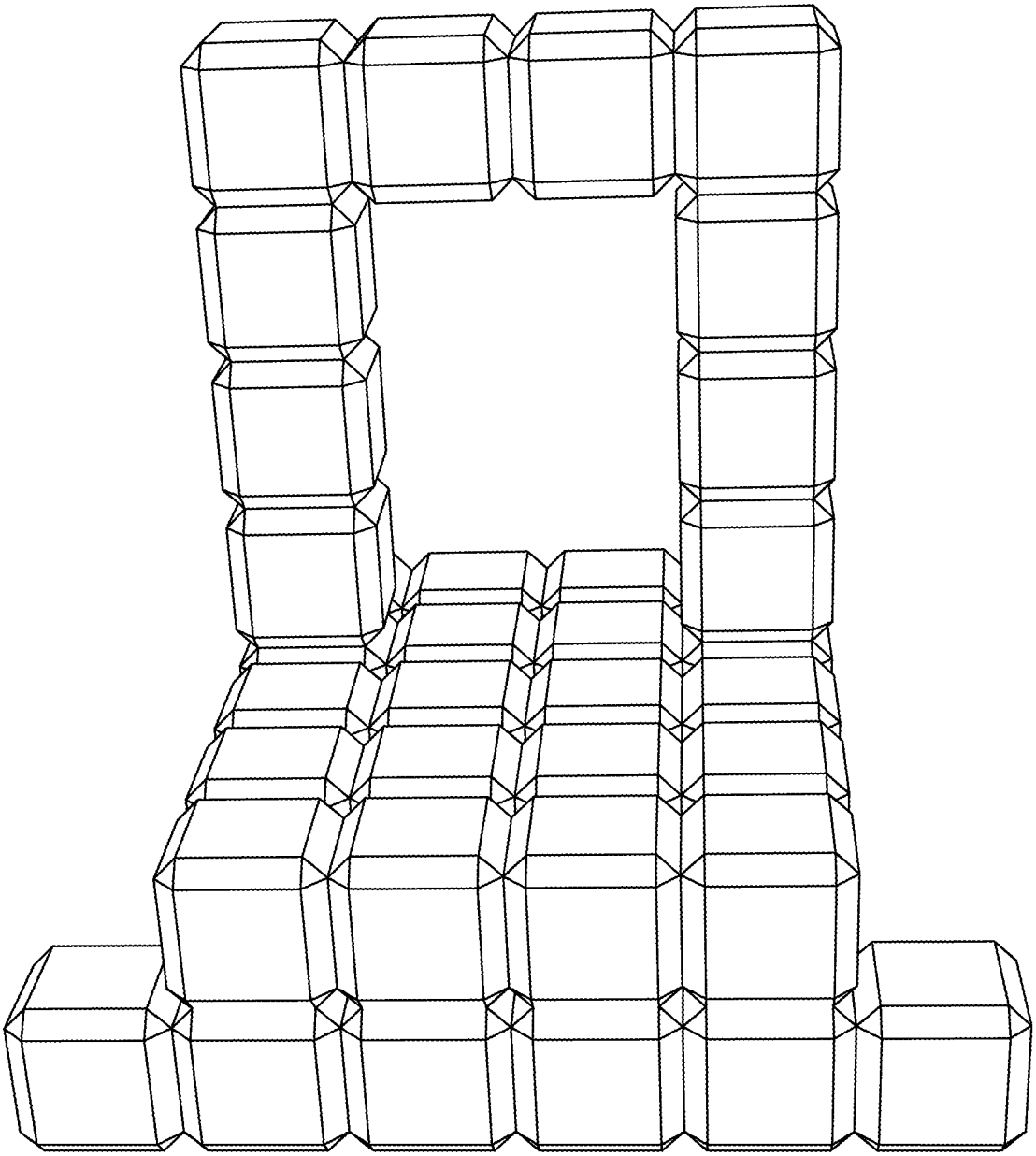
FIG. 5 is another picture of the building blocks when assembled.

During assembly, four magnets 140 are placed on friction fit holes 115 of sidewalls 114 of base component 130. The fifth magnet 140 is then placed into the cavity of base component 110. Middle pin 120 is then positioned into the cavity of base component 130 over the fifth magnet 140. The sixth magnet is then positioned into recessed cavity 139 of top component 130. Top component 130 is then connected to base component 110. When assembled, as illustrated in FIG. 3, FIG. 4, and FIG. 5, building block 100 has six flat square faces where building blocks 100 would join together. All edges of building block 100 are flattened or rounded to increase overall strength and provide a comfortable and safer experience when handling.

The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A magnetic block comprising: a base component, a middle pin, and a top component, wherein the base component has a base surface and a series of square sidewalls that are continuously connected and extend upward from an inner portion of the base surface to a top surface connected to each of the series of sidewalls to form a cube, wherein the cube extends upward farther than an outer perimeter of the base surface so as for the top component to extend downward past the series of sidewalls to be directly touching the base surface for an appearance of a seamless construction, wherein the cube has a plurality of circular recesses with surrounding ridges that extend perpendicularly outward from the series of sidewalls towards the top component.

2. The magnetic block of claim 1, wherein magnets are installed in the base component and the top component.

3. The magnetic block of claim 2, wherein the base component is hollow with an interior cavity.

4. The magnetic block of claim 1, wherein there are four circular recesses on the series of sidewalls for holding four magnets and an interior cavity extending downward from the top surface of the cube.

5. A magnetic block comprising: a base component, a middle pin, and a top component, wherein the base component a base surface and a series of square sidewalls that are continuously connected and extend upward from an inner portion of the base surface to a top surface wherein the base surface is of a greater perimeter than a perimeter formed by the series of square sidewalls, wherein the series of square sidewalls of the base component extend upward farther than a remainder of the base surface, wherein the top component has a top surface and a series of sidewalls that extend downward from the top surface wherein the series of sidewalls of the top component are positioned downward past the series of square sidewalls of the base component until coming into direct contact with the base surface, wherein four magnets are installed on the series of square sidewalls, wherein a fifth magnet is positioned in an interior cavity of the base component which extends downward from the top surface of the base component, wherein a sixth magnet is positioned in a recess at a top of the top component, wherein the middle pin is positioned in the interior cavity of the base component between the fifth magnet and the sixth magnet, wherein the base component has a friction fit hole on each of the series of square sidewalls to hold the four magnets.

6. The magnetic block of claim 5, wherein the friction fit holes have surrounding ridges that extend outward perpendicularly from an entirety of the series of square sidewalls.

7. The magnetic block of claim 5 wherein the top component has archways on an inner surface.

8. A magnetic block comprising: a base component, a middle pin, and a top component, wherein the base component has a flat base surface at an inner bottom of the base component and a series of square sidewalls that are continuously connected and extend upward from an inner portion of the flat base surface to a top surface that is connected to each of the series of sidewalls, wherein the top surface has an aperture that extends downward into a cavity, wherein the cavity receives the middle pin, wherein the series of square sidewalls extend upward farther than a remainder of the flat base surface, wherein the top component extends downward past the series of square sidewalls to be directly contacted with the flat base surface, wherein the series of sidewalls each have circular ridges that extend perpendicularly outward from the series of sidewalls.

9. The magnetic block of claim 8, wherein the flat base surface is of a greater perimeter than a perimeter formed by the series of square sidewalls.

10. The magnetic block of claim 8, wherein an outer surface of the magnetic block has a top portion and a bottom portion that extend inward to a center of the magnetic block from a plurality of continuously connected outer sidewalls.

* * * * *